United States Patent [19]

Thacker

[11] Patent Number: 4,464,247

[45] Date of Patent: Aug. 7, 1984

[54] HORIZONTAL FLUID BED RETORTING PROCESS

[75] Inventor: Milton B. Thacker, Salt Lake City, Utah

[73] Assignee: Standard Oil Company (Indiana), Chicago, Ill.

[21] Appl. No.: 541,525

[22] Filed: Oct. 13, 1983

[51] Int. Cl.[3] ..... C10G 1/02; C10B 53/06

[52] U.S. Cl. ..... 208/11 R; 208/8 R; 201/31; 422/142; 202/134

[58] Field of Search ..... 208/8 R, 11 R; 201/31; 422/142; 202/134, 135, 145

[56] References Cited

U.S. PATENT DOCUMENTS

| | | | |
|---|---|---|---|
| 2,560,767 | 7/1951 | Huff | 208/11 R |
| 2,626,234 | 1/1953 | Barr et al. | 208/11 R |
| 2,832,725 | 4/1958 | Scott, Jr. | 208/11 R |
| 3,117,064 | 1/1964 | Friedrich | 208/11 R |
| 3,663,421 | 5/1972 | Parr | 208/11 R |
| 4,080,181 | 3/1978 | Feistel et al. | 201/31 |
| 4,210,492 | 7/1980 | Roberts | 208/8 R |
| 4,419,215 | 12/1983 | Voetter et al. | 208/11 R |

*Primary Examiner*—Delbert E. Gantz
*Assistant Examiner*—Lance Johnson
*Attorney, Agent, or Firm*—Thomas W. Tolpin; William T. McClain; William H. Magidson

[57] ABSTRACT

A horizontal fluid bed retorting process is provided for preheating, retorting, combusting, and recovering heat from oil shale and other solid hydrocarbon-containing material. In the process, the combustor and heat recovery chambers share a common heat-conductive metal wall with and are positioned in side-by-side relationship to the cellular preheating and retorting chambers. The heat of combustion in the combustor and the heat recovered from the combusted shale or other material in the heat recovery chamber are transferred by conduction into the retorting and preheating chambers, respectively, to provide the process heat requirements for preheating and retorting the oil shale or other feed. The oil shale or other feed is fluidly moved in a generally horizontal S-shaped flow pattern through the preheating and retorting chambers in countercurrent flow to the combusted material in the combustor and heat recovery chambers.

20 Claims, 7 Drawing Figures

RAW OIL SHALE
CRUSHER
12
14
SPENT SHALE
132
112
AIR
108
122
AIR
102
HEAT RECOVERY
30
PRE HEAT
16
COMBUSTOR
28
RETORT
26
22
24
20
18
54
56
10
PRODUCT STREAM
64
TO COMBUSTOR
66
62
68
70
72
LIGHT GASES
74
WATER
LIGHT OIL
76
MIDDLE OIL
78
HEAVY OIL
80

COMBUSTION GASES
138
HEATED AIR
136
106
104
COMBUSTOR
100
98
HEAT RECOVERY
134
AIR
72
56

100
HEAT RECOVERY
140
98
WATER
STEAM
142

HORIZONTAL FLUID BED RETORTING PROCESS

BACKGROUND OF THE INVENTION

This invention relates to a process for retorting synthetic fuels, and more particularly, to a fluid bed process for retorting oil shale, tar sands and other solid hydrocarbon-containing material.

Researchers have now renewed their efforts to find alternate sources of energy and hydrocarbons in view of recent rapid increases in the price of crude oil and natural gas. Much research has been focused on recovering hydrocarbons from solid hydrocarbon-containing material such as oil shale, coal and tar sands by pyrolysis or upon gasification to convert the solid hydrocarbon containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, steam and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts in aboveground vessels or in in situ retorts under ground. In principle, the retorting of shale and other hydrocarbon-containing materials, such as coal and tar sands, comprises heating the solid hydrocarbon-containing material to an elevated temperature and recovering the vapors and liberated effluent. However, as medium grade oil shale yields approximately 20 to 25 gallons of oil per ton of shale, the expense of materials handling is critical to the economic feasibility of a commercial operation.

In order to obtain high thermal efficiency in retorting, carbonate decomposition should be minimized.

Colorado Mahogany zone oil shale contains several carbonate minerals which decompose at or near the usual temperature attained when retorting oil shale. Typically, a 28 gallon per ton oil shale will contain about 23% dolomite (a calcium/magnesium carbonate) and about 16% calcite (calcium carbonate), or about 780 pounds of mixed carbonate minerals per ton. Dolomite requires about 500 BTU per pound and calcite about 700 BTU per pound for decomposition, a requirement that would consume about 8% of the combustible matter of the shale if these minerals were allowed to decompose during retorting. Saline sodium carbonate minerals also occur in the Green River formation in certain areas and at certain stratigraphic zones. The choice of a particular retorting method must therefore take into consideration carbonate decomposition as well as raw and spent materials handling expense, product yield and process requirements.

In surface retorting, oil shale is mined from the ground, brought to the surface, crushed and placed in vessels where it is contacted with a hot solid heat carrier material, such as hot spent shale, ceramic balls, metal balls, or sand or a gaseous heat carrier material, such as light hydrocarbon gases, for heat transfer. The resulting high temperatures cause shale oil to be liberated from the oil shale leaving a retorted, inorganic material and carbonaceous material such as coke. The carbonaceous material can be burned by contact with oxygen at oxidation temperatures to recover heat and to form a spent oil shale relatively free of carbon. Spent oil shale which has been depleted in carbonaceous material is removed from the retort and recycled as heat carrier material or discarded. The combustion gases are dedusted in cyclones or electrostatic precipitators.

Some well-known processes of surface retorting are: N-T-U (Dundas Howes retort), Kiviter (Russian), Petrosix (Brazilian), Lurgi-Ruhrgas (German), Tosco II, Galoter (Russian), Paraho, Koppers-Totzek, Fushan (Manchuria), Union, gas combustion and fluid bed. Process heat requirements for surface retorting processes may be supplied either directly or indirectly.

Directly heated surface retorting processes, such as the N-T-U, Kiviter, Fushan and gas combustion processes, rely upon the combustion of fuel, such as recycled gas or residual carbon in the spent shale, with air or oxygen within the bed of shale in the retort to provide sufficient heat for retorting. Directly heated surface retorting processes usually result in lower product yields due to unavoidable combustion of some of the products and dilution of the product stream with the products of combustion. The Fushan process is shown and described at pages 101-102, in the book *Oil Shales and Shale Oils*, by H. S. Bell, published by D. Van Norstrand Company (1948). The other processes are shown and described in the *Synthetic Fuels Data Handbook*, by Cameron Engineers, Inc. (Second Edition, 1978).

Indirectly heated surface retorting processes, such as the Petrosix, Lurgi-Ruhrgas, Tosco II and Galoter processes, utilize a separate combustor or heater for heating solid or gaseous heat-carrying material which is injected, while hot, into the shale in the retort to provide sufficient heat for retorting. Generally, indirect heating surface retorting processes result in higher yields and less dilution of the retorting product than directly heated surface retorting processes, but at the expense of additional solids handling.

Fluid bed surface retorting processes are particularly advantageous. The use of fluidized bed contacting zones has long been known in the art and has been widely used in fluid catalytic cracking of hydrocarbons. When a fluid is passed at a sufficient velocity upwardly through a contacting zone containing a bed of subdivided solids, the bed expands and the particles are buoyed and supported by the drag forces caused by the fluid passing through the interstices among the particles. The superficial vertical velocity of the fluid in the contacting zone at which the fluid begins to support the solids is known as the "minimum fluidization velocity." The velocity of the fluid at which the solid becomes entrained in the fluid is known as the "terminal velocity" or "entrainment velocity." Between the minimum fluidization velocity and the terminal velocity, the bed of solids is in a fluidized state and it exhibits the appearance and some of the characteristics of a boiling liquid. Because of the quasi-fluid or liquid-like state of the solids, there is typically a rapid overall circulation of all the solids throughout the entire bed with substantially complete mixing, as in a stirred-tank reaction system.

Typifying those prior art fluidized bed retorting processes, fluid catalytic cracking processes, transfer line processes and similar processes are the Union Carbide/-Battelle coal gasification process, the fluid coker and flexicoking processes described at page 300 of the *Synthetic Fuels Data Handbook*, by Cameron Engineers, Inc. (Second Edition, 1978) and those found in U.S. Pat. Nos. 2,471,119; 2,506,307; 2,518,693; 2,608,526; 2,657,124; 2,626,234; 2,634,233; 2,643,218; 2,643,219; 2,684,931; 2,793,104; 2,799,359; 2,807,571; 2,844,525; 3,039,955; 3,152,245; 3,281,349; 3,297,562; 3,499,834; 3,501,394; 3,617,468; 3,663,421; 3,703,052; 3,803,021; 3,803,022; 3,855,070; 3,867,110; 3,890,111; 3,891,402; 3,929,585; 3,976,558; 3,980,439; 4,052,172; 4,064,018; 4,087,347; 4,110,193; 4,125,453; 4,133,739; 4,137,053; 4,141,794; 4,148,710; 4,152,245; 4,157,245; 4,183,800; 4,199,432; 4,210,491; and 4,247,987, as well as in U.S. patent applications, Ser. Nos. 293,694 filed Aug. 17, 1981, 333,039 filed Dec. 21, 1981, and 333,040 filed Dec. 21, 1981. Cooling of spent shale is described in U.S. patent application, Ser. No. 208,163 filed Nov. 19, 1980. These prior art processes have met with varying degrees of success.

A problem with some prior art fluidized bed processes is the long residence time at high temperatures which results in many secondary and undesirable side reactions such as thermal cracking, which usually increases the production of less desirable gaseous products and decreases the yield and quality of desirable condensable products. Therefore, in any process designed to produce the maximum yield of high quality condensable hydrocarbons, it is preferred that the volatilized hydrocarbons are quickly removed from the retorting vessel in order to minimize deleterious side reactions such as thermal cracking.

Another problem with many prior art processes, particularly with countercurrent fluidized bed flow processes, using solid heat carrier material as the heat source, is that after the shale oil has been vaporized, it then comes in contact with countercurrent flowing solids which are at a much cooler temperature, which leads to condensation of a portion of the shale oil and reabsorption of a portion of the vaporized shale oil into the downward flowing shale. This condensation and reabsorption leads to coking, cracking and polymerization reactions, all of which are detrimental to producing the maximum yield of condensable hydrocarbons.

A further problem with many prior art fluidized bed processes is that they often have low lateral mixing and high backmixing resulting in poor plug flow, and excessive bed volumes. Moreover, many prior art fluidized bed processes require high fluidizing velocities and pressures.

It is therefore desirable to provide an improved fluid bed retorting process whichever comes most, if not all, of the preceding problems.

SUMMARY OF THE INVENTION

An improved fluid bed retorting process is provided to retort synthetic fuels, such as oil shale, tar sands and other solid hydrocarbon-containing material. In the novel process, raw solid hydrocarbon-containing material is indirectly heated in a cellular retort to a retorting temperature. The cellular retort has a series of barriers extending upwardly from a floor and a series of upright baffles spaced above the floor. The baffles are positioned alternately between the barriers.

In the process, the raw solid hydrocarbon-containing material is fluidly moved generally horizontally through the cellular retort in a generally S-shaped flow pattern for a sufficient amount of time at the retorting temperature to liberate light hydrocarbon gases and oil from the raw hydrocarbon-containing material leaving retorted coked material. This is accomplished by systematically injecting a fluidizing lift gas into the cellular retort to fluidly lift the raw hydrocarbon-containing material over the barriers and allowing the raw hydrocarbon-containing material to gravitate beneath the baffles. Care should be taken to prevent combustion in the retorting section.

The retorted coked material is substantially combusted in a horizontal combustor. The horizontal combustor is positioned in side-by-side relationship with the cellular retort and has a common wall with the cellular retort. Heat generated during combustion provides the heat for retorting in the cellular retort. Combustion is accomplished by injecting an oxidizing gas, such as air, into the horizontal combustor to fluidly lift the retorted material over at least one upright barrier. The retorted material gravitates beneath at least one upright baffle in the combustor. Desirably, the retorted material fluidly moves in a generally horizontal flow direction generally opposite the horizontal flow direction of the raw hydrocarbon-containing material in the cellular retort.

Preferably, the combusted material is fluidly cooled in a horizontal heat recovery chamber positioned downstream of the horizontal combustor. Cooling is obtained by injecting a fluidizing, cooling gas into the heat recovery chamber. In one embodiment, the fluidizing, cooling gas is air. In another embodiment, the fluidizing, cooling gas is combustion gases emitted in the horizontal combustor.

The combusted shale can be further cooled by passing one or more cooling mediums in direct or preferably indirect heat exchange relationship with the combusted material in the heat recovery chamber. In the preferred form, the cooling medium comprises at least some of the light hydrocarbon gases liberated in the retort and separated in a fractionator or other separator. The light hydrocarbon gases cool the combusted material and are heated in the heat recovery chamber. The heated light hydrocarbon gases are recycled and injected into the retort section for use as the fluidizing lift gas in the retort section.

The cooling medium can also include air. The air cools the combusted material and is itself heated in the heat recovery chamber. Desirably, the heated air is recycled to the horizontal combustor for use as the oxidizing gas.

Water can also be used as the cooling medium in the heat recovery chamber. The water cools the combusted material and is itself vaporized into steam in the heat recovery chamber. Such an arrangement can be useful if other associated operations require steam.

In the preferred form, the raw hydrocarbon-containing material is fluidly preheated in a horizontal preheating chamber positioned upstream of the cellular retort. Most preferably, the preheating chamber is also positioned in side-by-side relationship with the heat recovery chamber. Preheating is accomplished by injecting a fluidizing lift gas, preferably preheated light hydrocarbon gases, into the preheating chamber.

In the preferred embodiment, the product stream of light hydrocarbon gases and oil is at least partially dedusted in at least one cyclone positioned upstream of the fractionator. Dust from the cyclone is fed into and combusted in the horizontal combustor. Effluent gases emitted in the combustor are dedusted in a cyclone or electrostatic precipitator. Dust from the cyclone or electrostatic precipitator is fed into the heat recovery chamber. In the illustrative embodiment, the effluent gases from the heat recovery chamber is dedusted in another cyclone or electrostatic precipitator. Dust from this other cyclone or electrostatic precipitator is transported downstream with the combusted spent material for moisturization, heat recovery and disposal.

As used throughout this application, the terms "retorted" solid hydrocarbon-containing material or "retorted" shale refers to solid hydrocarbon-containing material or oil shale, respectively, which have been retorted to liberate hydrocarbons leaving a material containing carbon residue or coke.

The terms "spent" solid hydrocarbon-containing material or "spent" shale as used herein means retorted solid hydrocarbon-containing material or retorted oil shale, respectively, from which essentially all the carbon residue or coke has been removed by combustion.

The terms "fluid bed" and "fluidized bed" as used herein mean a bed of raw, retorted or spent hydrocarboncontaining material or shale which has been fluidized by a gas.

The term "normally liquid" is relative to the condition of the subject material at a temperature of 77° F. (25°C.) and a pressure of one atmosphere.

A more detailed explanation of the invention is provided in the following description and appended claims taken in conjunction with the accompanying drawings.

DETAILED DESCRIPTION OF THE PREFERRED EMBODIMENT

A horizontal cellular fluid bed process and system 10 (FIGS. 1 and 2) is provided to retort solid hydrocarbon-containing material, such as oil shale, tar sands, coal, uintaite (gilsonite), lignite, peat and oil-containing diatomaceous earth (diatomite), for use in producing synthetic fuels. While the process of the present invention is described hereinafter with particular reference to the processing of oil shale, it will be apparent that the process can also be used to retort other solid hydrocarbon-containing materials such as tar sands, coal, uintaite (gilsonite), lignite, peat and oil-containing diatomaceous earth (diatomite), etc.

In the cellular retorting process and system, raw oil shale is fed to a crushing and screening station 12 by screw feeder, conveyor or other feeding means. The oil shale should preferably contain an oil yield of 15 gallons per ton of shale particles in order to supply most of the combustion fuel and heat requirements. At the crushing and screening station, raw oil shale is crushed, sized and sorted by conventional crushing equipment such as an impact crusher, jaw crusher, gyratory crusher, or roll crusher and by conventional screening equipment such as a shaker screen or vibrating screen and discharged into feed line 14. Oil shale particles greater than 10 mm should be recrushed because such particles can adversely effect fluidizing and retorting of smaller, oil shale particles.

Figure 1:
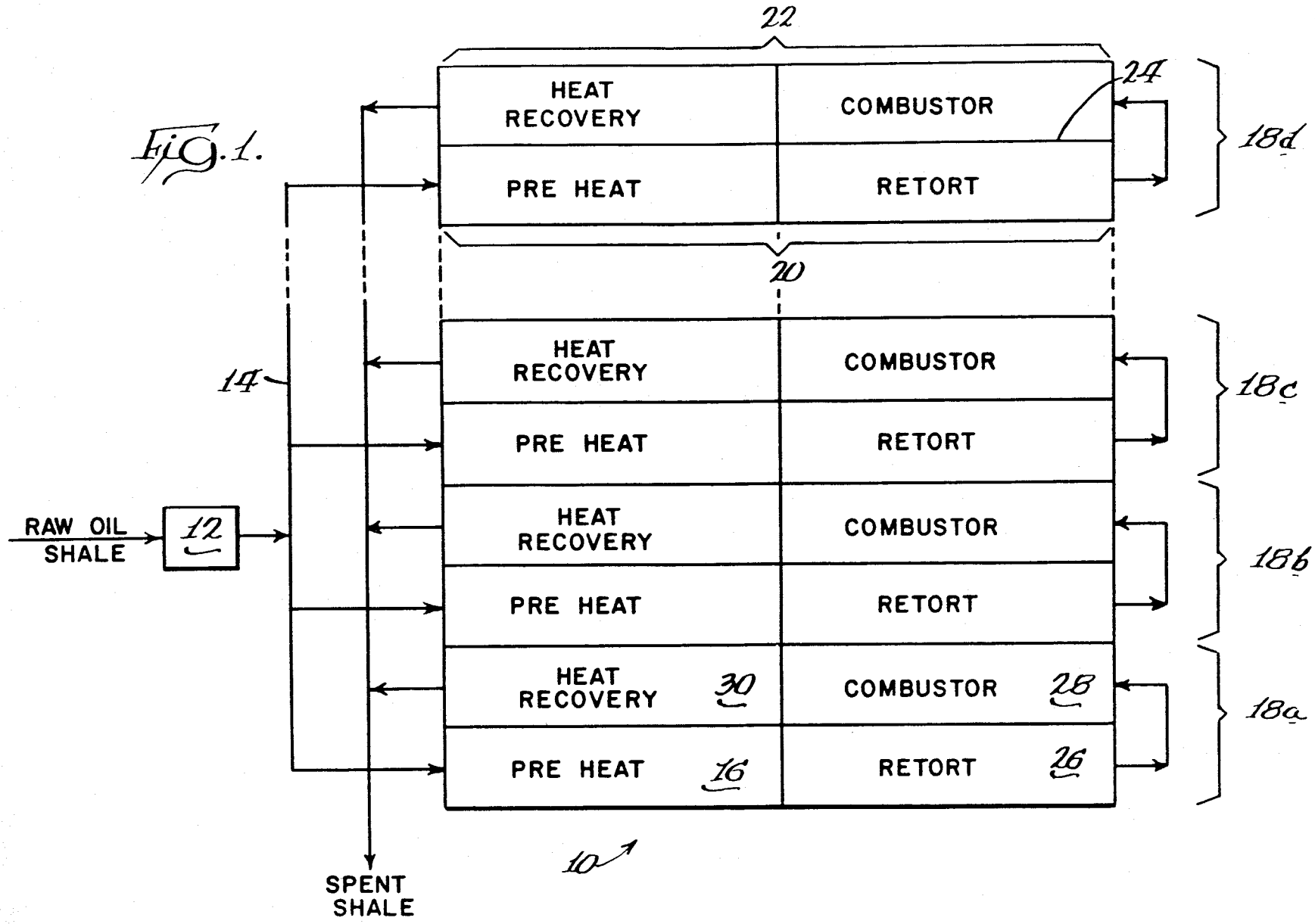
FIG. 1 is a schematic flow diagram with a plan view of an array of preheating, retorting, combustion and heat recovery chambers for processing oil shale or other solid hydrocarbon-containing material in accordance with principles of the present invention.

The crushed oil shale particles in feed line 14 is conveyed to the preheating section 16 of an array of cellular processing units 18*a*, 18*b*, 18*c* and 18*d* (FIG. 1). Each unit has a cellular horizontal preheating and retorting chamber 20 and a combustion and heat recovery (cooling) chamber 22. The cellular arrangement of the cellular units allow heat transfer to take place from solids to solids with substantial isolation for each section function. Chambers 20 and 22 are positioned in side-by-side or back-to-back relationship and have a common heat conductive (transmissive), metal wall 24. Wall 24 extends longitudinally between and bisects chambers 20 and 22. The preheating and retorting chambers of internal cellular units share a common heat conductive (transmissive) metal wall with the combustion and heat recovery chambers of adjacent cellular units and visa versa. The preheating and retorting chamber 20 has a preheating section 16 and a retorting section 26 positioned in longitudinal alignment with each other. The combustion and heat recovery chamber 22 has a combustion section 28 and a heat recovery and cooling section 30 in longitudinal alignment with each other.

The preheating and heat recovery sections of the cellular units are in lateral alignment with each other. The retorting and combustion sections of the cellular units are in lateral alignment with each other. The preheating and retorting sections are heated by indirect heat transfer between the combusting shale in the combustor and heat recovery sections and the raw shale in the cellular chamber by separating the cellular chamber from the combustor and heat recovery chamber with a steel wall thin enough for effective heat transfer but thick enough to withstand the hot fluidized solids. In order to enhance heat transfer, the cells should have a large surface to volume ratio. Thermal efficiency is obtained by building the cells in blocks so that almost all cell walls are used for heat transfer. Thermal efficiency is further achieved in the process by circulating the raw oil shale and combusted shale in countercurrent flow to each other. Supplemental heaters can be used to heat the outside of the preheating and retorting sections. Supplemental coolers can also be used to cool the outside combustor and heat recovery section walls.

Heat generated in the combustion sections heat the adjacent retorting sections to a retorting temperature ranging from 800° F. to 1400° F., and most preferably from 900° F. to 1200° F., to liberate an effluent product stream of light hydrocarbon gases and shale oil from the raw oil shale. Heat generated and recovered in the heat recovery sections are used in part to heat adjacent preheating sections to a temperature ranging from 250° F. to 600° F., and more preferably, from 300° F. to 550° F. to preheat the raw oil shale before it enters the cellular retorts.

The cellular dense-phase, fluid bed retorting unit is a horizontal fluid bed retorting system in which the shale is heated primarily by conduction through steel walls separating the preheating and retorting sections from the heat recovery and combustion sections, respectively. The raw oil shale solids are fluidized in each cell of the cellular chamber and are carried horizontally through the chamber by a system of lift pipes in the cells. Multiple cells, preferably five inches to ten inches wide, are used to maximize wall surface area for heat transfer. In one embodiment, the cells are 9 inches wide, 25 feet high and 12 feet long. The expanded fluidized beds of solids are about 15 feet high with the additional 10 feet of height as a disengaging zone. Desirably, these cells are only 9 inches wide to maximize the heat transfer surfaces between cells. Other cell sizes can also be used. The fluidizing cells in the cellular chamber are in side-by-side relationship and positioned in a horizontal array. Oil shale flow is cycled only once through the cells with little if any solids recycle.

Figure 5:
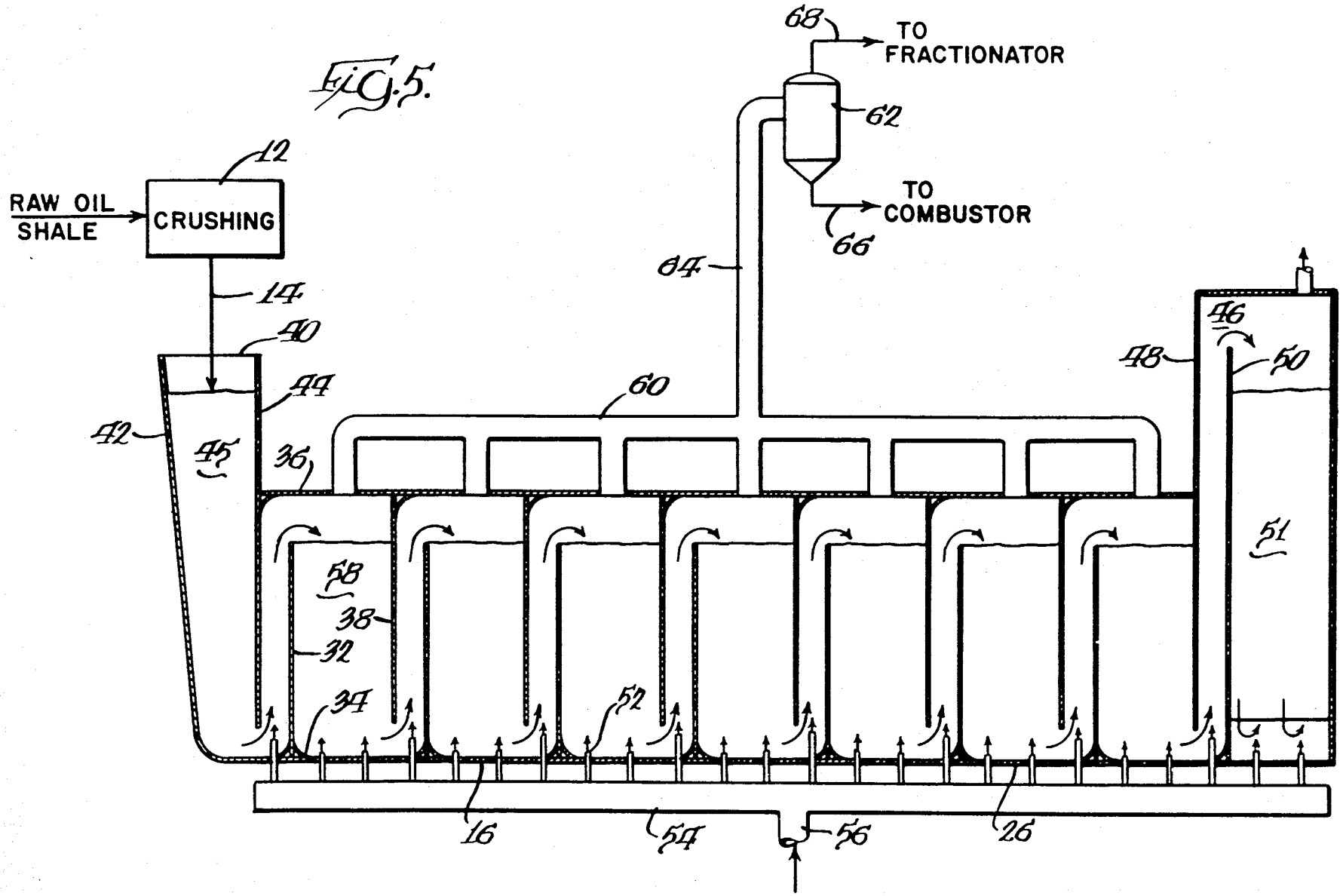
FIG. 5 is a schematic flow diagram of the cellular preheating section and retort.

As shown in FIG. 5, the preheating section 16 and the retorting section 26 of the cellular chamber is made of a lateral (horizontal) array of cells. Each cell has an upright fluid impervious, and imperforate metal barrier, weir or wall 32 which extends vertically upwardly from a foraminous floor 34 to a position spaced below the ceiling 36 of the cellular chamber. Each cell also has an upright, fluid impervious, and imperforate metal baffle or wall 38 which extends vertically downward from the ceiling 36 to a position spaced above the floor 34.

The mouth 40 and outwardly flared walls 42 and 44 upstream of the inlet cell of the preheating section provides an upright lock hopper 45 which extends above the ceiling 36. The discharge mouth 46 and vertical walls 48 and 50 downstream of the exit cell of the retorting section provide an upright seal leg 51 which extend above the ceiling of the cellular retort. In some circumstance, it may be desirable that the lock hopper and seal leg be the same height as the cellular chamber.

In the cellular chamber (FIG. 5), a series of fluidizing gas injectors 52 extend upwardly to or through the foraminous floor 34 of the preheating and retorting sections. The injectors are connected to and fluidly communicate with a manifold or supply pipe 54 and a fluidizing lift gas supply line 56.

Crushed and screened oil shale is delivered to the lock hopper feeder 45 from which it is fed by gravity to the first cell of the preheating section. Hot product gases are used as the fluidizing medium. Heat transfer through the cell walls of the preheating section from the adjacent heat recovery section, heat the raw oil shale in the preheating section and drive off (evaporate) the moisture in the raw oil shale. At the end of each cell, a jet of product gas lifts the oil shale up a lift pipe into the next cell. In the illustrative embodiment four cells are used in the preheating section to preheat the oil to approximately 300° F. to 550° F. before entering the retorting section and four retorting cells are used to complete retorting of the raw oil shale from 800° F. to 1000° F. Different numbers of multiple cells can be used depending on the overall length and size of the system. The retorted shale is discharged from the retorting section and lifted with flue gas to a stand pipe 51 that acts as a seal leg between the retort and the combustor. The retorted shale is propelled and fluidly lifted to a greater height at the exit of the retorting section to allow a sufficient seal leg.

An inert fluidizing lift gas is injected into the cells through injectors 52, via manifold 54 and supply line 56, to fluidize the shale and fluidly lift the raw oil shale over the upright barriers into laterally moving, fluidized or pulsed beds 58. The location of the injectors and pressure of the fluidizing gas is arranged so that the raw oil shale gravitates below the upright baffles 38 of adjacent cells. The fluidizing lift gas can also be injected into the cellular chamber in pulses to form pulsed beds. In the preferred arrangement, fluidized shale beds are used in the cellular chamber by continually injecting the fluidizing lift gas into the cells.

Each cell contains a downwardly moving, pulsed or fluidized bed of raw oil shale particles depending on the amount, duration and pressure of the fluidizing lift gas. In order to attain a moving shale bed, the lift gas can be injected at a pressure ranging from 1 psig to 50 psig, preferably 2 psig to 25 psig, at a superficial gas velocity of 0.1 to 10 ft/sec and preferably from 1 to 5 ft/sec. Greater pressures and velocities can be used to attain fluidized shale beds in the cells. Pulsed beds can be attained by injecting the lift gas in pulses. Excessive lift gas velocity should be avoided because it has a tendency to break apart the oil shale particles.

Preferably, recycled light hydrocarbon gases which have been liberated from the oil shale during retorting and heated in the heat recovery section, are used as the fluidizing lift gas in the preheating and retorting sections of the cellular chamber. Recycle product gas is used to fluidize an essentially all hydrocarbon system in the preheating and retorting sections which for safety reasons, are at a slightly higher pressure than the combustor to keep out oxygen and air. Air and substantial portions of molecular oxygen are substantially prevented from entering the preheating and retorting sections of the cellular chamber to prevent combustion of the raw oil shale and burning of the product stream in the cellular preheating and retorting chamber.

If desired, the retorting section can have separate isolated cellular retorting zones for progressive, separate and distinct retort operating temperatures and product liberation. If additional separation between the retorting and combustion sections is desired, a screw feeder or rotary valve can be used.

The raw oil shale fluidly moves through the preheating section and retorting section of the cellular chamber in a generally horizontal S-shaped flow pattern over the barriers and under the baffles (left to right in FIG. 5). The oil shale can also be fluidly moved in a generally horizontal sinusoidal flow pattern through the cellular retort (left to right in FIG. 5).

Effluent gases emitted in the preheating section and the effluent products stream liberated from the raw oil shale in the retorting section are withdrawn from the top of the cellular chamber through an overhead manifold 60. The effluent gases and product stream are conveyed to one or more cyclones 62 through a common gas and product line 64. The effluent gases and product stream are partially dedusted in the cyclone(s). Dust from the cyclone(s) are transported to the combustion section via transport line 66. In the illustrative embodiment, the retorting equipment (chambers) are operated at about 4 psig to allow sufficient pressure for proper cyclone efficiency. Other pressures can also be used.

Figures 2, 3, 4:
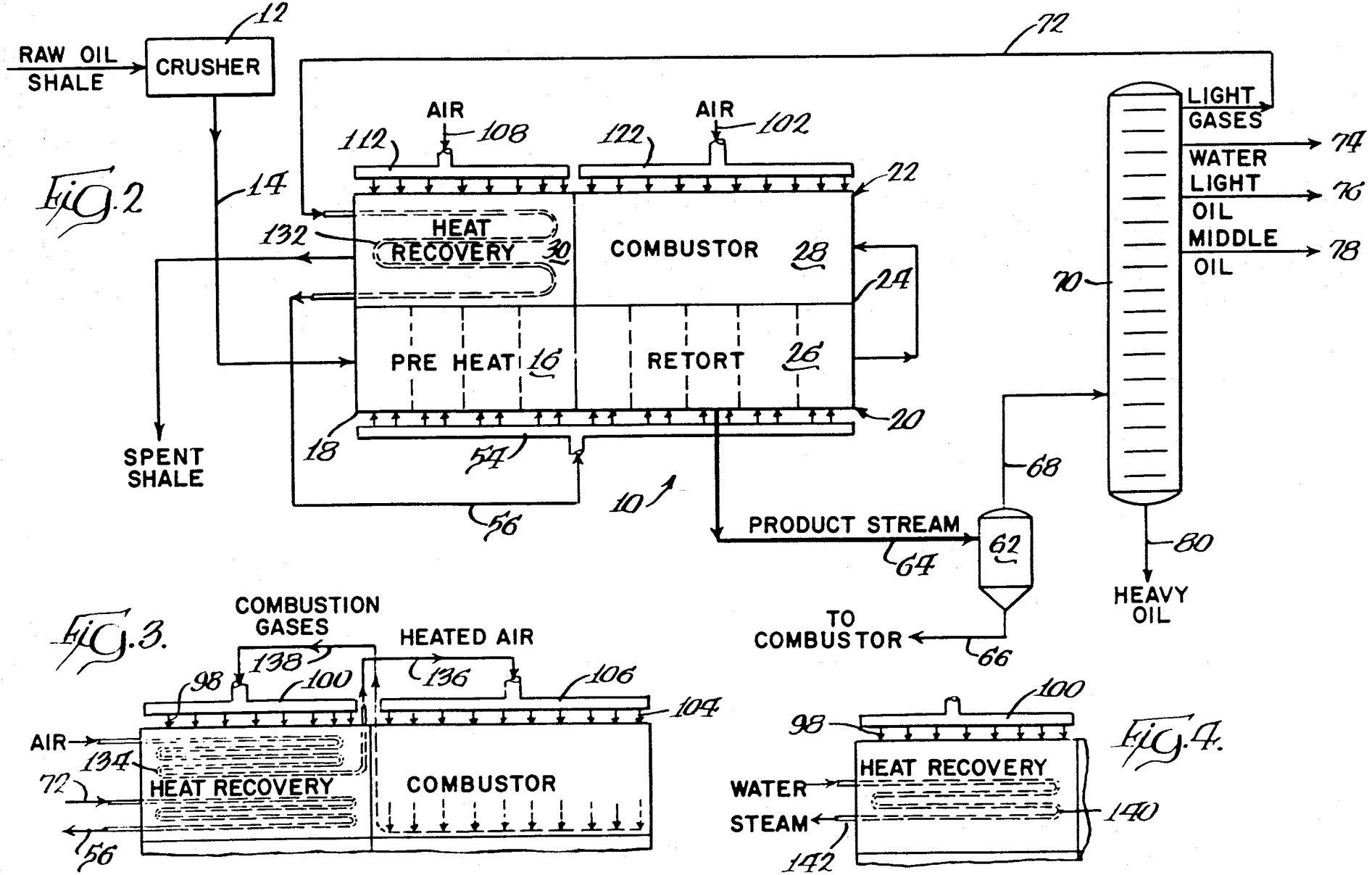
FIG. 2 is a schematic flow diagram of a retorting process with a plan view of a preheating, retorting, combustion and heat recovery chamber in accordance with principles of the present invention.
FIG. 3 is a schematic plan view of the combustor and another heat recovery chamber.
FIG. 4 is a schematic plan view of a further heat recovery chamber.

The dedusted gases and product stream from the cyclone(s) are passed through overhead cyclone line 68 to one or more separators 70 (FIG. 2). In the preferred embodiment, the separator is a fractionating column, sometimes referred to as a fractionator or a distillation column. Other types of separators can also be used, such as a quenching tower or scrubber.

In the separator 70, the effluent gases and product stream can be separated into fractions of light hydrocarbon gases, water, light shale oil, middle oil shale, and heavy shale oil. The light hydrocarbon gases, water, light shale oil, middle shale oil, and heavy shale oil are withdrawn from the separator through light gas line 72, water line 74, light shale oil line 76, and heavy shale oil line 78, respectively. Heavy shale oil has a boiling point over 600° F. to 800° F. Middle shale oil has a boiling point over 400° F. to 500° F. Light shale oil has a boiling point over 100° F. The effluent oil and gases from the separator can be dedusted further in downstream dedusting equipment and upgraded in a catalytic cracker or hydrotreater or otherwise processed down- stream.

Figure 6:
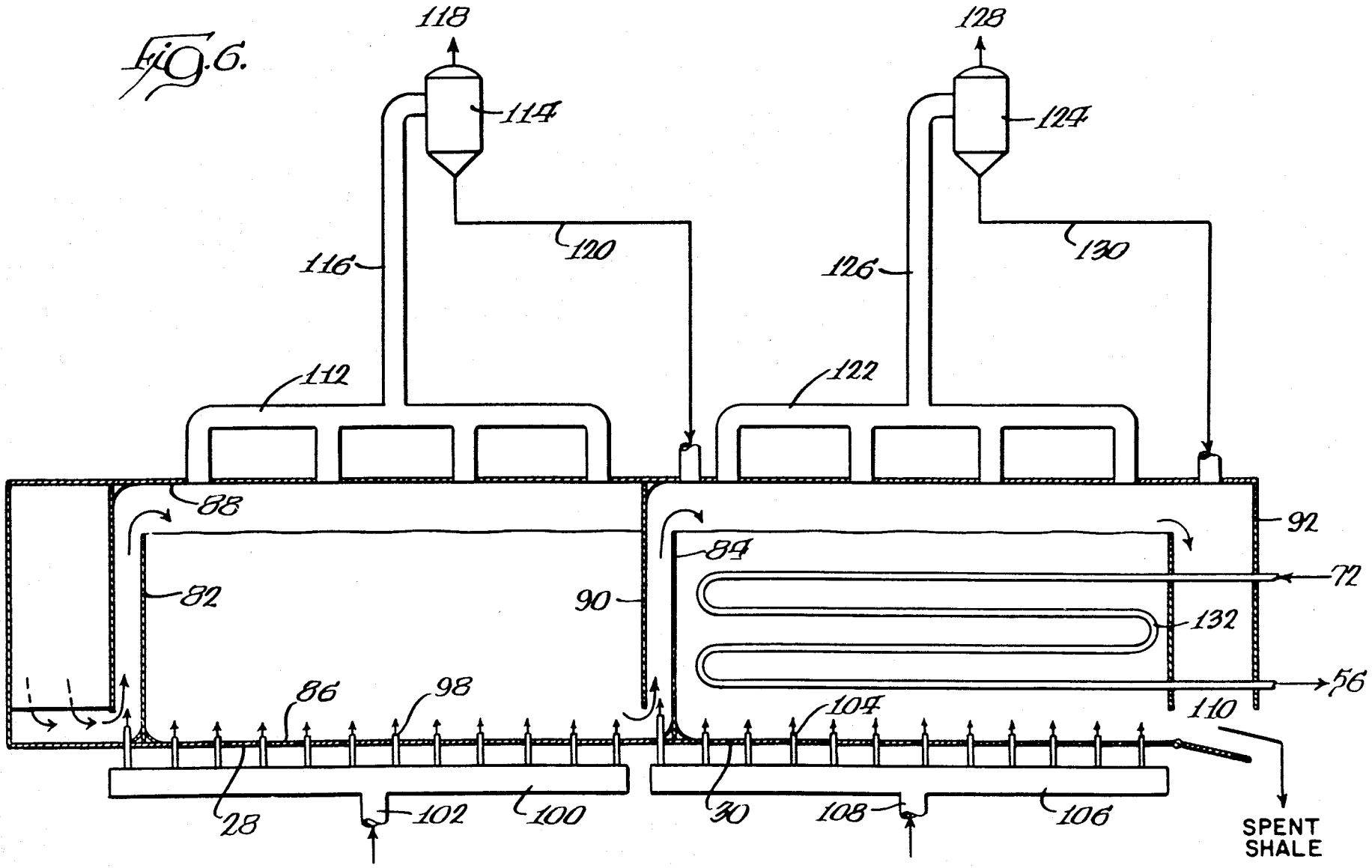
FIG. 6 is a schematic flow diagram of the horizontal combustor and heat recovery (cooling) chamber.
Figure 7:
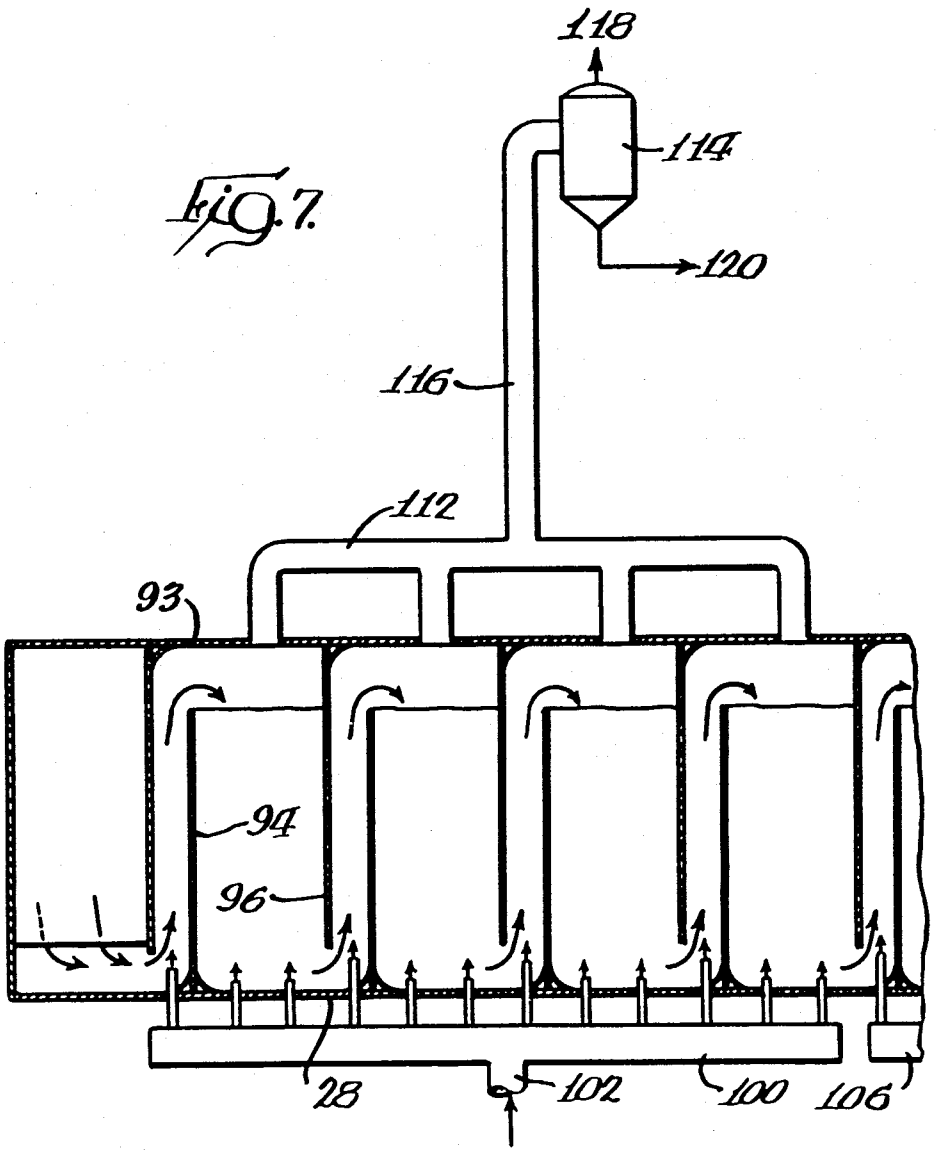
FIG. 7 is a schematic flow diagram of another cellular combustor.

As shown in FIG. 6, the combustion section 28 and the heat recovery (cooling) section 30 of the combustion and heat recovery chamber, each have at least one upright fluid impervious, and imperforate metal barrier or wall 82 or 84 extending vertically upwardly from a foraminous floor 86 to a position spaced below the ceiling 88 of the chamber. The combustion section and heat recovery section also have at least one upright fluid impervious, imperforate metal baffle or wall 90 or 92 which extends vertically downward from the ceiling 88 to a position spaced above the foraminous floor 86. A cellular combustor 93 with a series of alternating upright barriers 94 and baffles 96 providing cells can also be used as the combustion section as shown in FIG. 7. A cellular heat recovery and cooling section with a series of alternating upright barriers and baffles providing cells can also be used.

In the embodiment of FIG. 6, an oxygen-containing, combustion-sustaining lift gas or oxidizing gas, preferably air, is injected into the combustion section through a series of injectors 98 extend up to or through the foraminous floor. The injectors are connected to and fluidly communicate with inlet manifold 100 and air supply line 102. The air is injected into the combustion section with sufficient pressure and velocity to fluidize the retorted coked shale from the retorting section (cellular retort) and fluidly lift the retorted coke shale over the barriers in the combustion section. The air substantially combusts the residual carbon and coke on the retorted shale, generating heat for the retorting section and leaving combusted spent shale. The air can be injected into the combustion section at a pressure and velocity similar to the pressure and velocity of the fluidizing lift gas in the cellular chamber. The placement of the injectors and pressure of the air is regulated to permit the shale to gravitate below the baffles in the combustor.

The combustion reactions take only a few seconds and the solids residence time of the shale in each cell is about four minutes. Retorted shale and coked dust in the combustor are fluidized with the combustion air and carbon dioxide produced in the combustor.

Carbon residue (coke) on the retorted shale is the source of most of the heat energy required in the combustor. If additional heat is required, it can be supplied by burning fuel gas or oil in the combustor. The coked dust provides additional fuel. If desired, carbonate decomposition can be induced in the combustor by adding supplementary fuel and air.

Injectors 104 (FIG. 6) extend upwardly to or through the foraminous floor of the heat recovery and cooling section (chamber) 30. The injectors are connected and fluidly communicate with an inlet manifold 106 and an air supply line 108. A fluidizing cooling gas is injected through the injectors 104 via the manifold and the air supply line into the heat recovery and cooling section to fluidize and cool the combusted shale from the combustor and fluidly lift the combusted shale over the barriers in the heat recovery and cooling section. The placement of the injectors and the pressure of the fluidizing cooling gas should be regulated to permit the combusted shale to gravitate beneath the baffles and out of the outlet 110 of the heat recovery and cooling section. The cooled combusted shale is discharged from the outlet of the heat recovery section by a screw or rotary feeder (conveyor) or a discharge valve. The heat recovery section recovers heat for the preheating section.

The retorted and combusted shale is fluidly moved generally horizontally through the combustion and heat recovery sections of the horizontal combustion and heat recovery chamber in countercurrent flow relationship to the raw oil shale in the cellular preheating and retorting chamber. The retorted and combusted shale fluidly move in a generally horizontal S-shaped flow pattern over the barriers and under the baffles in the combustion and heat recovery sections, respectively. The retorted and combusted shale can also be moved in a generally horizontal sinusoidal flow pattern through the combustion and heat recovery sections.

Combustion gases emitted during combustion in the combustor are discharged to an overhead combustion gas manifold 112 (FIG. 6) and passed to a cyclone 114 via combustion gas line 116. The combustion gases are dedusted in cyclone 114 and are vented to the atmosphere or processed further downstream via line 118. Dust from cyclone 114 is fed to the heat recovery section through combustion dust line 120. Heat is recovered from the combustion dust in the heat recovery section in the same manner as heat is recovered from the combusted oil shale.

The effluent gases from the heat recovery and cooling section are withdrawn through an overhead effluent gas manifold 122 (FIG. 6) and are passed to a cyclone 124 via effluent gas line 126. The effluent gases are dedusted in cyclone 124 and are vented to the atmosphere or passed to a compressor or other downstream processing equipment via line 128. The dust from cyclone 124 is passed through dust discharge line 130 and discharged with the cooled shale through outlet 110 for spent shale moisturization, further downstream processing and/or waste disposal.

In some circumstances it may be desirable to connect manifolds 112 and 122 and pass the combustion gases and effluent gases through one or more common cyclones. Electrostatic precipitators, ceramic filters or bag houses can be used in lieu of or in conjunction with the cyclones.

The effluent gases from the heat recovery and cooling section and/or the combustor can be compressed in a compressor and injected into the preheating section for use as the fluidizing lift gas.

The dust and combusted shale in the heat recovery and cooling section can be further cooled and further heat can be recovered from the dust and combusted shale by passing a cooling medium through the heat recovery and cooling section in direct, and preferably indirect, heat exchange relationship with the dust and combusted shale. In the preferred embodiment, light hydrocarbon gases from the separator 70 (FIG. 2) are passed through overhead gas line 72 through a zig-zag heat exchange gas line 132 in the heat recovery and cooling section 30. The light hydrocarbon gases in the zig-zag pipe line cool the dust and combusted shale in the heat recovery and cooling section and absorb a substantial portion of the heat therefrom. The heated light hydrocarbon gases are passed out of the heat recovery section through the gas supply line 56 where it is injected into the preheating and retorting chamber for use as the fluidizing lift gas.

As shown in FIG. 3, air can also serve as the cooling medium. This is preferably accomplished by pumping ambient air through a zig-zag heat exchange air line 134 in the heat recovery and cooling section. The air cools the dust and combusted shale in the heat recovery and cooling section and absorbs a substantial amount of the heat therefrom. The heated air is withdrawn from the heat recovery and cooling section and passed through air line 136 into the combustor 28 for use as the fluidizing oxidizing gas.

In the embodiment of FIG. 3, combustion gases emitted in the combustor are withdrawn through combustion gas line 138 and injected into the heat recovery and cooling section via manifold 100 and injectors 98 for use as the fluidizing cooling gas. The combustion gases emitted in the combustor preferably contain 5% to 10% excess air.

As shown in FIG. 4, water can also be used as the cooling medium to cool the dust and combusted shale and recovery heat therefrom. Preferably, water is passed through a zig-zag heat exchange water line 140 through the heat recovery and cooling section. The heat absorbed by the water is sufficient to vaporize the water and form steam. The steam is withdrawn from the heat recovery and cooling section through steam line 142 for use in steam turbines, electrical generation and/or other downstream processing operations.

The use of light hydrocarbon gases, air and/or steam as the cooling media for subsequent use in the process and the use of combustion gases as the fluidizing cooling gas in the heat recovery section in the manner described greatly enhances the thermal efficiency and substantially lowers the operating cost of the process.

A cleaner oil is liberated in the retort than in conventional retorts because the raw oil shale is indirectly heated by conduction rather than solid heat carrier material, such as, spent shale, sand or ceramic or metal balls. Cleaner oil saves on product recovery costs.

Among the many advantages of the horizontal fluid bed retorting process are low pressure, simple construction and low height requirements (less than 100 feet), moderate carbonate decomposition and the absence of mixing raw oil shale with spent oil shale which reduces decrepitation and the level of dust (mineral fines) in the product oil.

Although embodiments of this invention have been shown and described, it is to be understood that various modifications and substitutions, as well as rearrangements and combinations of parts and process steps, can be made by those skilled in the art without departing from the novel spirit and scope of this invention. What is claimed is:

1. A process for retorting solid hydrocarbon-containing material, comprising the steps of:

(a) indirectly heating raw solid hydrocarbon-containing material in a cellular retort to a retorting temperature, said cellular retort having a series of barriers extending generally upwardly from a floor and a series of generally upright baffles spaced above said floor, said baffles positioned alternately between said barriers;

(b) fluidly moving said raw solid hydrocarbon-containing material generally horizontally through said cellular retort over said barriers and under said baffles in a generally S-shaped flow pattern for a sufficient period of time at said retorting temperature to liberate light hydrocarbon gases and oil from said raw solid hydrocarbon-containing material leaving retorted coked hydrocarbon-containing material by injecting a fluidizing lift gas into said cellular retort to fluidly lift said raw hydrocarbon-containing material over said barriers, and gravitating said raw hydrocarbon-containing material beneath said baffles, while simultaneously substantially preventing combustion in said cellular retort;

(c) substantially combusting said retorted coked material in a generally horizontal combustor in side-byside relationship and having a common wall with said cellular retort to generate said indirect heat for step (a) and form spent material including injecting an oxygen-containing, combustion-sustaining gas into said horizontal combustor to fluidly lift said retorted material over at least one generally upright barrier in said horizontal combustor, gravitating said retorted material beneath at least one generally upright baffle in said horizontal combustor, and fluidly moving said retorted material generally horizontally through said horizontal combustor in a flow direction generally opposite the flow direction of said raw hydrocarbon-containing material in said cellular retort.

2. A process in accordance with claim 1 wherein said solid hydrocarbon-containing material is selected from the group consisting of oil shale, tar sands, coal, lignite, peat, uintaite and oil-containing diatomaceous earth.

3. A process in accordance with claim 1 including fluidly cooling said combusted material in a generally horizontal heat recovery chamber positioned downstream and communicating with said horizontal combustor by injecting a fluidizing cooling gas into said horizontal heat recovery chamber while simultaneously passing a cooling medium in heat exchange relationship with said combusted material in said heat recovery chamber.

4. A process in accordance with claim 3 wherein:

said combustion sustaining gas and said cooling medium is air, and, said air is heated by said spent shale in said heat recovery chamber before being injected into said horizontal combustor.

5. A process in accordance with claim 4 wherein said fluidizing cooling gas is air.

6. A process in accordance with claim 4 wherein combustion gases are emitted in said combustor and recycled for use as said fluidizing cooling gas in said heat recovery chamber.

7. A process in accordance with claim 3 wherein:

said cooling medium comprises some of said light hydrocarbon gases;

said light hydrocarbon gases are heated in said heat recovery chamber; and said heated light hydrocarbon gases are recycled for use as said fluiding lift gas in said cellular retort.

8. A process in accordance with claim 7 including fluidly preheating said raw hydrocarbon-containing material in a generally horizontal preheating chamber positioned upstream and communicating with said cellular retort and in side-by-side relationship with said heat recovery chamber by injecting said heated light hydrocarbon gases into said raw hydrocarbon-containing material in said preheating chamber.

9. A process in accordance with claim 1 including fluidly moving said retorted material in a generally S-shaped flow pattern over a series of generally upright barriers and gravitatingly beneath a series of generally upright baffles between said upright barriers in said horizontal combustor.

10. A process in accordance with claim 1 wherein said raw hydrocarbon-containing material is fluidly moved in a generally sinusoidal flow pattern through said cellular retort.

11. A process for retorting oil shale, comprising the steps of:

indirectly heating raw oil shale in a generally horizontal cellular chamber having a preheating section and a retorting section, said cellular chamber having a series of barriers extending generally upwardly from a foraminous floor and a series of generally upright baffles spaced above said floor, said baffles positioned alternately between said barriers;

fluidly moving said raw oil shale substantially through said cellular chamber in a generally horizontal S-shaped flow pattern over said barriers and under said baffles by injecting a fluidizing lift gas through said foraminous floor into said cellular chamber to fluidly lift said raw oil shale over said barriers and gravitating said raw oil shale beneath said baffles, said raw oil shale being heated to a temperature ranging from about 300° F. to about 550° F. in said preheating section to preheat said raw oil shale and to a retorting temperature ranging from 800° F. to 1000° F. in said retorting section to liberate an effluent product stream from said raw oil shale leaving retorted coked shale, substantially preventing combustion in said cellular chamber;

separating fractions of light hydrocarbon gases and shale oil from said effluent product stream in a separator selected from the group consisting of a fractionator, a quench tower and a scrubber; and fluidly moving said retorted coked shale generally horizontally through a generally horizontal chamber in countercurrent flow relationship to said raw oil shale in said cellular chamber, said horizontal chamber having a combustion section and a heat recovery and cooling section, said combustion section positioned in side-by-side relationship and having a common wall with said retorting section, said heat recovery and cooling section positioned in side-by-side relationship and having a common wall with said preheating section, said retorted coked shale being fluidly moved through said combustion section by injecting air into said combustion section to fluidly lift said retorted shale over at least one generally upright barrier in said combustion section to substantially combust said retorted coked shale and generate said heat for said retorting section and gravitating said shale beneath at least one generally upright baffle in said combustion section, said combusted shale being fluidly moved through said heat recovery section by injecting a fluidizing cooling gas selected from the group consisting essentially of air and combustion gases emitted in said combustion section into said heat recovery section to cool said combusted shale and generate said heat for said preheating section and spilling said combusted shale over at least one generally upright barrier in said heat recovery section.

12. A process in accordance with claim 11 wherein:

said raw oil shale is crushed to a fluidizable size before being fluidly moved through said cellular chamber; and said combusted shale is removed from said heat recovery section and moisturized.

13. A process in accordance with claim 11 wherein said light hydrocarbon gases from said separator are passed through said heat recovery section in heat exchange relationship with said combusted shale to heat said light hydrocarbon gases and cool said combusted shale, and said heated light hydrocarbon gases are passed to said preheating section and said retorting section to provide said fluidizing lift gas in said cellular chamber.

14. A process in accordance with claim 11 wherein said air is passed through said heat recovery section in heat exchange relationship to heat said air and cool said combusted shale before said air is injected into said combusting section.

15. A process in accordance with claim 14 wherein said combustion gases from said combustion section are injected into said heat recovery section for use as said fluidizing cooling gas.

16. A process in accordance with claim 11 wherein water is passed through said heat recovery section in indirect heat exchange relationship with said combusted shale to generate steam.

17. A process in accordance with claim 11 wherein laterally moving shale beds are formed in said chambers.

18. A process in accordance with claim 11 wherein fluidized shale beds are formed in said chambers.

19. A process in accordance with claim 11 wherein:

effluent gases emitted in said combustion section are at least partially dedusted in at least one cyclone;

dust from said cyclone is fed into said heat recovery section;

said product stream is at least partially dedusted in at least one other cyclone positioned upstream of said separator; and dust from said other cyclone is fed into and combusted in said combustion section.

20. A process in accordance with claim 11 wherein said retorted coked shale is fluidly moved in a generally horizontal S-shaped flow pattern in said combustion section.

* * * * *

UNITED STATES PATENT OFFICE

CERTIFICATE OF CORRECTION

Patent No. 4,464,247 Dated AUGUST 7, 1984

Inventor(s) Milton B. Thacker

It is certified that error appears in the above-identified patent and that said Letters Patent are hereby corrected as shown below:

| Patent Column | Line | |
|---|---|---|
| 4 | 10 | reads "whichever comes" and should read --which overcomes-- |
| 5 | 47-48 | reads "hydrocarboncontaining" and should read --hydrocarbon-containing-- |
| 6 | 54 | reads "visa" and should read --vice-- |
| 9 | 30 | reads "middle oil shale-- and should read --middle shale oil-- |
| 9 | 41 | reads "down-stream" and should read --downstream-- |
| 9 | 62 | reads "extend" and should read --extending-- |
| 11 | 55 | reads "recovery" and should read --recover-- |
| 12 | 4 | delete the "," after "as" |
| 12 | 47 | reads "byside" and should read --by-side-- |
| 13 | 10 | change ",and," to --; and-- |

Signed and Sealed this

*Eighth* Day of *July 1986*

[SEAL]

*Attest:*

DONALD J. QUIGG

*Attesting Officer* *Commissioner of Patents and Trademarks*